US008561929B2

(12) United States Patent
Davis

(10) Patent No.: US 8,561,929 B2
(45) Date of Patent: Oct. 22, 2013

(54) MOBILE SIZING STATION

(75) Inventor: Glenn Davis, Spokane, WA (US)

(73) Assignee: FLSmidth A/S (DK)

( * ) Notice: Subject to any disclaimer, the term of this patent is extended or adjusted under 35 U.S.C. 154(b) by 0 days.

(21) Appl. No.: 13/883,669

(22) PCT Filed: Oct. 31, 2011

(86) PCT No.: PCT/US2011/058572

§ 371 (c)(1),
(2), (4) Date: May 6, 2013

(87) PCT Pub. No.: WO2012/064541

PCT Pub. Date: May 18, 2012

(65) Prior Publication Data

US 2013/0221143 A1 Aug. 29, 2013

Related U.S. Application Data

(60) Provisional application No. 61/411,087, filed on Nov. 8, 2010.

(51) Int. Cl.

| | |
|---|---|
| ***B02C 23/02*** | (2006.01) |
| ***B02C 19/00*** | (2006.01) |
| ***B02C 7/06*** | (2006.01) |

(52) U.S. Cl.
USPC ..... 241/101.741; 241/224; 241/241; 241/285.3

(58) Field of Classification Search
USPC ..... 241/101.74, 101.741, 222, 223, 224, 241/285.1, 85.32; 222/168, 173
See application file for complete search history.

(56) References Cited

U.S. PATENT DOCUMENTS

| | | | | |
|---|---|---|---|---|
| 4,480,857 | A | 11/1984 | Graves | |
| 5,234,094 | A | 8/1993 | Weyermann et al. | |
| 7,182,284 | B2 * | 2/2007 | Jabs et al. | 241/101.74 |
| 7,806,353 | B2 * | 10/2010 | Douglas et al. | 241/101.74 |
| 8,020,800 | B2 * | 9/2011 | Potts | 241/101.74 |
| 2003/0141394 | A1 * | 7/2003 | Ueda et al. | 241/73 |
| 2007/0001044 | A1 * | 1/2007 | Irwin | 241/224 |
| 2009/0294560 | A1 * | 12/2009 | Yamaguchi et al. | 241/33 |
| 2010/0090042 | A1 | 4/2010 | Potts | |
| 2011/0114776 | A1 * | 5/2011 | Veneroso et al. | 241/285.3 |

OTHER PUBLICATIONS

The International Search Report and Written Opinion dated Apr. 3, 2012, 9 pages.

* cited by examiner

*Primary Examiner* — Faye Francis
(74) *Attorney, Agent, or Firm* — Aaron M. Pile; Daniel DeJoseph; Jeffrey A. Sharp

(57) ABSTRACT

A mobile sizing station includes a crushing device and a hopper device. A conveyor device extends between a hopper of the hopper device to a crusher mechanism of the crushing device to transport material fed to the hopper to the crusher mechanism to crush the material. The hopper of the hopper device is supported on a base that has a plurality of frame members. A first frame member is pivotally connected to a second frame member and is also rotatably supported such that the first frame member is rotatable. The second frame member is pivotally connected to a third frame member and the third frame member is connected to the hopper. The hopper is thereby rotatable and is tiltable about the pivotal connections between the second and third frame members and is also tiltable about the pivotal connection between the first and second frame members.

20 Claims, 12 Drawing Sheets

MOBILE SIZING STATION

FIELD OF INVENTION

The present invention relates to mobile crushing devices that utilize conveyors to transport material fed to the machine into a crushing device and move the crushed material from the crushing device to another device. An example of such a device is a mobile sizing station.

BACKGROUND OF THE INVENTION

In large scale fully mobile crushing stations, large sizing stations have capacities in the range of 8,000 tons per hour to 12,000 tons per hour of capacity for receiving material to be crushed and crushing that material to a desired size for further transport. Due to the size of such machines, the frame or chassis of the machines must be capable of supporting a substantial amount of weight. The machines usually include a hopper to receive material from mobile shovel loading devices such as rope shovel devices or front loading shovel devices. A conveyor is often used to transport the material fed to the hopper to a sizing device for sizing the material. Another conveyor below the sizing device typically receives that material and feeds it to another device such as a transport vehicle, luffing conveyor, or a conveyor device so that the sized material may be transported to a new location.

When it is desired to move the mobile station to a new location, many types of mobile sizing stations must be completely evacuated of any material so that the station may be moved or relocated to a new location. This is particularly true for systems that utilize a single fixed carbody for the frame of the device. The evacuation of the machine may take many hours of operational downtime during a working shift, which substantially elevates operational costs. These costs are greatly exacerbated by the fact that such mobile stations often have to move every few hours.

Other types of mobile sizing stations may utilize a hopper that is positioned on a portion of a tracked frame. The tracks may help make the mobile station more easily moveable when loaded with material. However, the track supported hoppers often greatly limit steering capabilities of the device. For instance, movement of the device over inclined portions of land may be difficult or slow, if not impossible, due to the weight of the hopper and the material retained in the hopper. Often, very wide ramps that use relatively small grades are utilized for moving such mobile stations. The small grades are usually needed to permit the station to be moveable along the inclined surface of the ramp. The work required to make such ramps greatly increases the operational costs associated with such mobile stations. Further, generally steering within a portion of a work site may be more time consuming and difficult due to the poor steering provided by such tracked mobile sizing stations.

A new mobile sizing station is needed that has a high capacity for receiving material to be crushed while also having improved mobility that reduces the downtime associated with the moving of the mobile station. Preferably the device is sized and configured to permit both lower operational costs and lower capital costs associated with the manufacture and use of the device.

SUMMARY OF THE INVENTION

A mobile sizing station may include a crushing device, a hopper device, and a conveyor device positioned between the crushing device and the hopper device. The conveyor device is configured to move material from a hopper of the hopper device to a crushing mechanism of the crushing device. The hopper device may include a base that moveably supports the hopper. The base may include at least one track connected to a carbody. The carbody may support a first frame portion, a second frame portion, and a third frame portion. The first frame portion is rotatably supported by the carbody. The second frame portion is pivotally connected to the first frame portion. The third frame portion is pivotally connected to the second frame portion. The second frame portion is positioned between the first and third frame portions.

The pivotal connection of the second frame portion to the third frame portion may include a plurality of first pins that define a first tilt axis for the hopper of the hopper device. The pivotal connection of the first frame portion to the second frame portion may include a plurality of second pins that define a second tilt axis for the hopper of the hopper device. The second tilt axis may be transverse, substantially perpendicular or perpendicular to the first tilt axis. In some embodiments, the second pins may be outer ring pins and the first frame portion may be an outer ring frame portion and the first pins may be inner ring pins and the second frame portion may be an inner ring frame portion. The third frame portion may be configured to directly connect to the hopper via at least one hopper mount.

Preferably, the conveyor device is an apron feed conveyor that is connected to a frame of the crushing device and the hopper device. The crushing device may have a base that is connected to the frame of the crushing device. The base of the crushing device may include one or more tracked carbodies.

It should be understood that embodiments of the mobile sizing station may be designed such that the crushing mechanism is at least one sizer or other crusher. The capacity of the sizer or other crusher may be configured to meet a particular design objective.

Embodiments of the mobile sizing station may include a discharge conveyor device that is connected to the crushing device so that the crushed material output from the crushing mechanism is fed to the discharge conveyor device. The discharge conveyor device may be utilized for moving crushed material to a transport mechanism such as a truck or conveyor. The discharge conveyor device may be connected to the crushing device such that the inclination of the discharge conveyor device is adjustable and such that the discharge conveyor device is rotatable.

In some embodiments of the mobile sizing station, the first, second, and third frame portions may be nested. The third frame portion may be positioned at a higher location than the first frame portion.

The base of the hopper device may include bearings that are connected to the carbody. The bearings may support the first frame portion such that the first frame portion is rotatable along a path defined by the bearings. The path may be generally circular such as a circular path or an elliptical path.

A mobile crushing station is also provided. The mobile crushing station may include a crushing device that has a crushing mechanism connected to a frame of the crushing device. The frame of the crushing device may be connected to a base of the crushing device. The base of the crushing device may have a plurality of tracks. The mobile crushing station may also include a hopper device that has a hopper and a conveyor device positioned between the crushing device and the hopper device. The conveyor device may be configured to move material from the hopper of the hopper device to the crushing mechanism of the crushing device so that material fed to the hopper is moveable to the crushing mechanism. The conveyor device is connected to the crushing device such that the conveyor device is moved to a new position when the crushing device moves to a new position via movement of the tracks of the crushing device. The hopper device also includes a base that moveably supports the hopper. The base includes a moveable support, a first frame portion, a second frame portion, and a third frame portion. The first frame portion is rotatably supported by the moveable support. The second frame portion is pivotally connected to the first frame portion and is positioned between the first and third frame portions. The third frame portion is pivotally connected to the second frame portion.

Preferably, the moveable support of the base of the hopper device includes a carbody that is connected to a plurality of tracks. The carbody may have a plurality of bearings attached thereto that provide the rotatable support to the first frame portion.

The first frame portion may be a ring shaped frame structure. The second frame portion may also be a ring shaped frame structure. The third frame portion may be a portion of the frame of the crushing device or may be a generally C-shaped frame structure.

A mobile sizing station is also provided that includes a crushing device having a crushing mechanism. A frame is connected to the crushing mechanism and a base is connected to the frame of the crushing device. The base of the crushing device has tracks. A hopper device having a hopper and a conveyor device connected between the crushing device and the hopper of the hopper device are also included in the mobile sizing station. The conveyor device is configured to move material from the hopper of the hopper device to the crushing mechanism of the crushing device. The hopper device also includes a base that moveably supports the hopper. The base includes at least one track connected to a carbody. The carbody supports a first frame portion, a second frame portion and a third frame portion. The first frame portion is supported by the carbody. The second frame portion is pivotally connected to the first frame portion and the third frame portion being pivotally connected to the second frame portion.

In some embodiments, the first frame portion is rotatably supported by the carbody via a plurality of bearings or a plurality of slew bearings connected to the carbody.

In some preferred embodiments, the mobile sizing station is configured such that it does not use hydraulic cylinders to lift and lower the hopper and material is retainable in the hopper during movement of the mobile sizing station to move the mobile sizing station along ground to a new location.

A mobile sizing station is also provided that includes a crushing device having a crushing mechanism. A frame is connected to the crushing mechanism and a base is connected to the frame of the crushing device. The base of the crushing device has tracks. A hopper device having a hopper and a conveyor device connected between the crushing device and the hopper of the hopper device are also included in the mobile sizing station. The conveyor device is configured to move material from the hopper of the hopper device to the crushing mechanism of the crushing device. The frame of the crushing device includes a moveable stanchion that is moveable from a lowered position to a raised position. The moveable stanchion is positioned adjacent to the crushing mechanism and supports the crushing mechanism when in the lowered position and does not support the crushing mechanism when in the raised position.

One or more actuators may be connected to the moveable stanchion to move the moveable stanchion from the lowered position to the raised position. At least one locking pin moving mechanism may also be included in embodiments of the mobile sizing station. The locking pin moving mechanism may move a locking pin from a locked position in which the locking pin is positioned adjacent to the moveable stanchion to lock the moveable stanchion in the lowered position to an unlocked position. The moveable stanchion may not be moveable to the raised position when the locking pin is in the unlocked position.

A discharge conveyor may be connected to the frame of the crushing device and may be configured to be pivoted to a position adjacent to ground such that the ground supports at least a portion of the discharge conveyor before the moveable stanchion is moveable from the lowered position to the raised position. Such movement of the discharge conveyor may be required prior to any movement of the moveable stanchion to the raised position in some embodiments of the mobile sizing station.

Certain embodiments of the mobile sizing station may also include a retention mechanism. For instance, the hopper device may also include of a retention mechanism. The retention mechanism may include one or more members or structures that extend from adjacent to the base of the hopper device to a position adjacent to the first frame portion of the hopper device or to a position adjacent to the second frame portion of the hopper device. The end of the members or structures adjacent to the first or second frame portion may be configured to be received within a groove or mate with a profile of the first or second frame portion when the first or second frame portion is tilted or otherwise moved to one or more predetermined positions.

Some embodiments of the mobile sizing station may also include a skirt. In one contemplated embodiment, the skirt may be attached to the third frame portion and may extend downwardly from the third frame portion to a position adjacent to the first frame portion. The bottom of the skirt may extend to a position below the first frame portion to cover the second and third frame portions and block debris or material that may fall frame the hopper or from a shovel device feeding material to the hopper. In some embodiments, the top portion of the skirt may be attached to the hopper or the main frame portion and a bottom portion of the skirt may be attached to the base of the hopper device or the first frame portion. In other embodiments, the top of the skirt may be connected to the third frame portion and the bottom of the skirt may hang and not be directly connected to other structure.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of mobile sizing stations are shown in the accompanying drawings.

DETAILED DESCRIPTION OF PRESENT PREFERRED EMBODIMENTS

Figure 1:
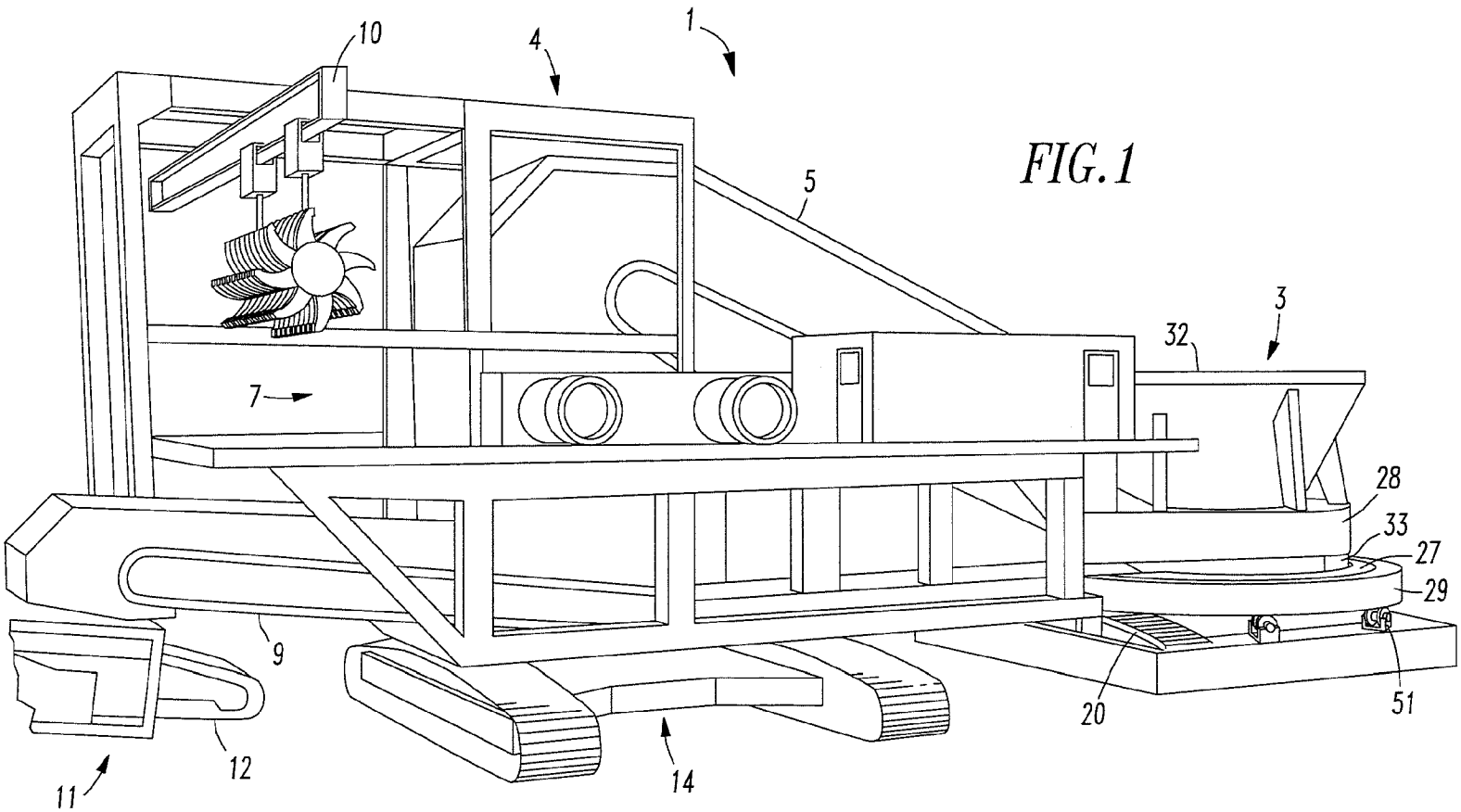
FIG. 1 is a perspective view of a first present preferred embodiment of the mobile sizing station with a portion of the discharge conveyor device 11 cut away.
Figure 2:
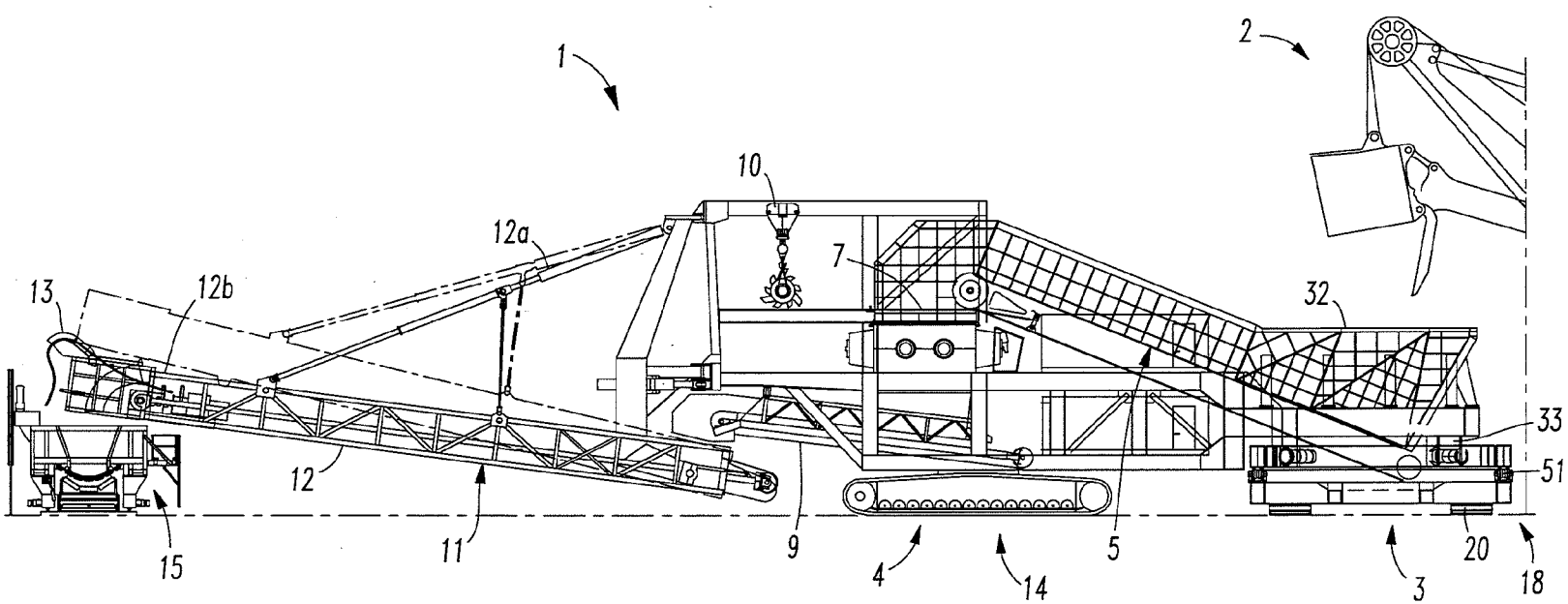
FIG. 2 is a side view of the first present preferred embodiment of the mobile sizing station that is in a position to receive material from a rope shovel device 2 and discharge crushed material to a conveyor device 15. A raised position of the discharge conveyor device 11 is illustrated in broken line. Also a portion of the outer ring frame portion 29, inner ring frame portion 27 and main frame portion 28 is cut away to show a portion of the apron feed conveyor 5.
Figure 3:
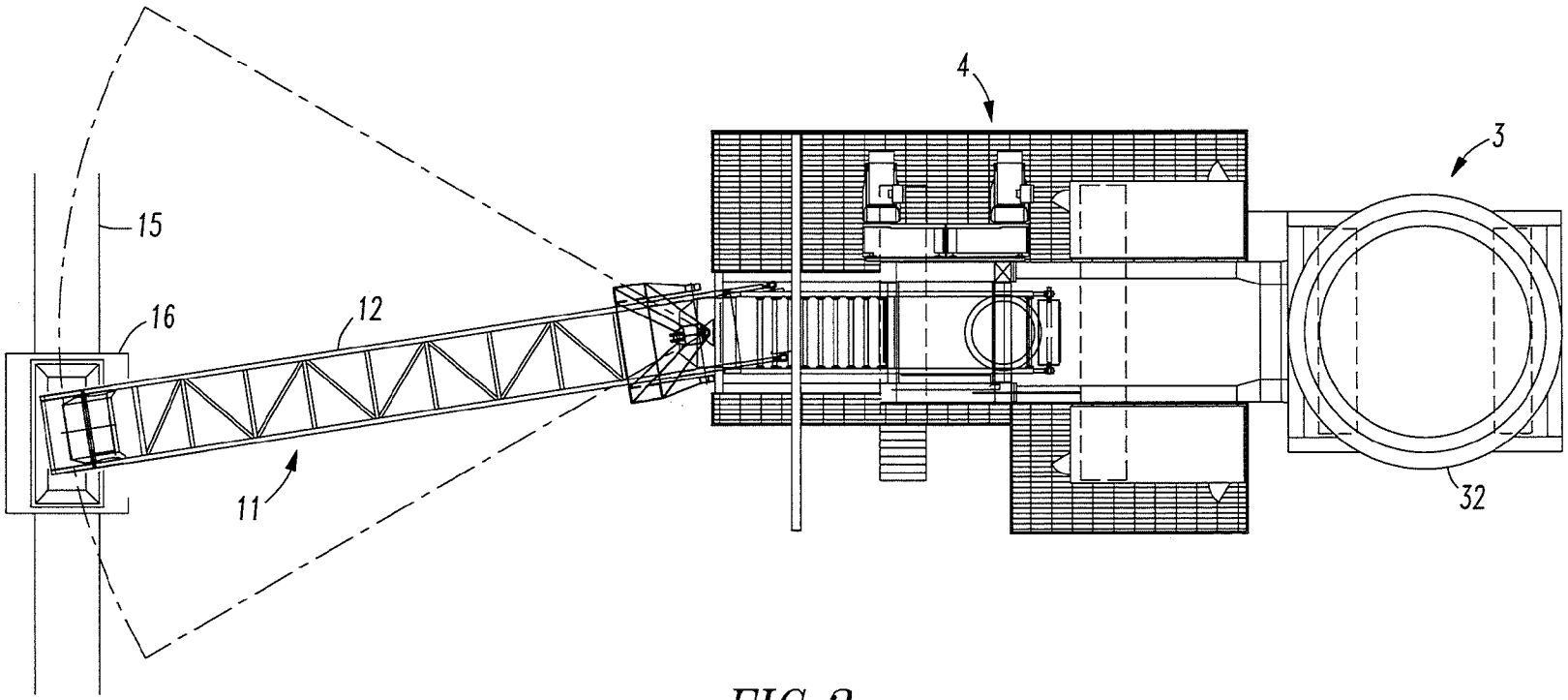
FIG. 3 is a top view of the first present preferred embodiment of the mobile sizing station. Movability of the discharge conveyor device 12 is indicated by broken line.

Referring to FIGS. 1-12, a mobile sizing station 1 may include a hopper device 3 connected to a crushing device 4 that feeds crushed material to a discharge conveyor device 11. The hopper device 3 may include a base that supports a hopper 32. The base of the hopper device 3 may be connected to tracks to permit movement of the hopper device via the tracks.

The crushing device 4 may have a frame that includes a base and a crushing mechanism, such as a sizer or other type of crusher. The base of the frame of the crushing device 4 may be connected to tracks. The tracks 14 of the crushing device 4 and hopper device 3 may permit movement of the moveable sizing station 1. The tracks 14 may be connected to a carbody that is attached to the frame of the crushing device 4. The carbody may also include hydraulic cylinders or other actuators to lift or lower the frame of the crushing device 4 relative to the tracks 14 to adjust the height of the crushing device 4. The frame of the crushing device 4 may also be connected to the carbody of the tracks 14 such that the frame is rotatable or pivotable relative to the carbody of the tracks 14. The carbody of the tracks 14 may also be pivotable or rotatable relative to the frame of the crushing device 4.

The hopper device 3 may include a hopper 32 that is sized and configured to receive material from one or more feed devices. The feed device may be, for instance, front loaders or shovel devices that shovel or feed material into the hopper 32. The material fed to the hopper may include, for example, rock, ore, stone, or other material. The hopper 32 may be of any number of dimensions and configurations to meet a design objective. Preferably, the hopper 32 is configured such that the height of the hopper 32 is about eight meters when the hopper device 3 is positioned on flat land.

An apron feeder 5 or other conveyor device may be connected to the crushing device and positioned to move material that is fed into the hopper 32 to a sizer 7 of the crushing device 4. An end of the apron feeder may extend through an opening 31 and into the hopper 32. The opening 31 may be defined by a portion of the hopper 32 and may also be defined by a portion of the frame of the hopper device that supports the hopper 32. A portion of the frame 23 of the crushing device 4 may extend from the crushing device 4 to the hopper device 3 to support an end portion of the apron feeder. The opposite end of the apron feeder and middle portion of the apron feeder 5 may be connected to the frame of the crushing device 4.

The apron feeder 5 may be, for example, an inclined conveyor belt. Preferably, the apron feeder 5 is sufficiently sized and configured to run at a sufficient speed for feeding a desired amount of material to the sizer 7 of the crushing device 4. For instance, the moveable belt of the apron feeder 5 may be configured to move at a rate of two feet per minute, three feet per minute, two meters per minute, or at other speeds or rates of travel for moving material fed into the hopper 32 to the sizer 7. Of course, the speed of the belt of the apron feeder 5 may be any of a number of other different rates for achieving one or more desired design objectives.

The sizer 7 may be connected to the frame of the crushing device 4. The sizer may have an opening to receive material from the hopper 32 via the apron feeder. One or more crushing mechanisms may be positioned inside the sizer 7 to crush material fed into the sizer to size the material or comminute the material to a predetermined size or range of acceptable sizes. The sized or crushed material may then be discharged to a belt feeder 9 positioned below the sizer. The belt feeder 9 may be a conveyor mechanism that is supported on the frame of the crushing device 4 and feeds material to a discharge conveyor device 11 that is also connected to the frame of the crushing device 4. In alternative embodiments, the discharge conveyor may be the belt feeder, may be a feed conveyor of a luffing conveyor device or may be another conveyor device.

The sizer may be a crushing mechanism or other type of crusher. For instance, the sizer may utilize one or more rotating crushing bodies or rollers that include projections or hammers for crushing material fed to the sizer 7 via the apron feeder 5.

The crushing device 4 may also include a crane mechanism 10 connected to the frame of the crushing device. The crane mechanism 10 may be utilized to repair or maintain the sizer 7. For instance, the crane mechanism 10 may include a crane that is sized and configured to be used to replace damaged crushing bodies of the sizer that may become damaged during use. As those of skill in the art may appreciate, such crushing bodies are typically moved to crush material within the sizer. Of course, the crane mechanism 10 may also be designed to provide other functionalities such as repair of the mobile sizing station 1 or maintenance of the station.

Figure 4:
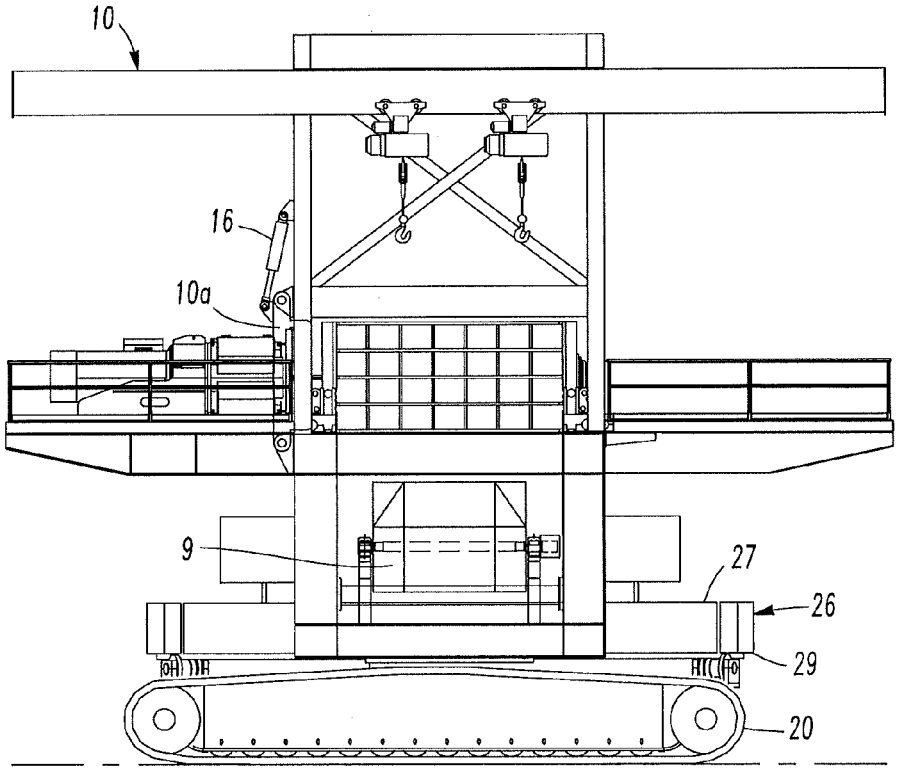
FIG. 4 is an end view of the first present preferred embodiment of the mobile sizing station with a portion of the hopper device and apron feeder cut away to better illustrate the belt feeder 9, sizer 7 and moveable frame stanchion 10*a*. The moveable frame stanchion 10*a* is shown in a lowered position in FIG. 4 and the tracks 20 of the hopper device 3 are shown in a first position.
Figure 4A:
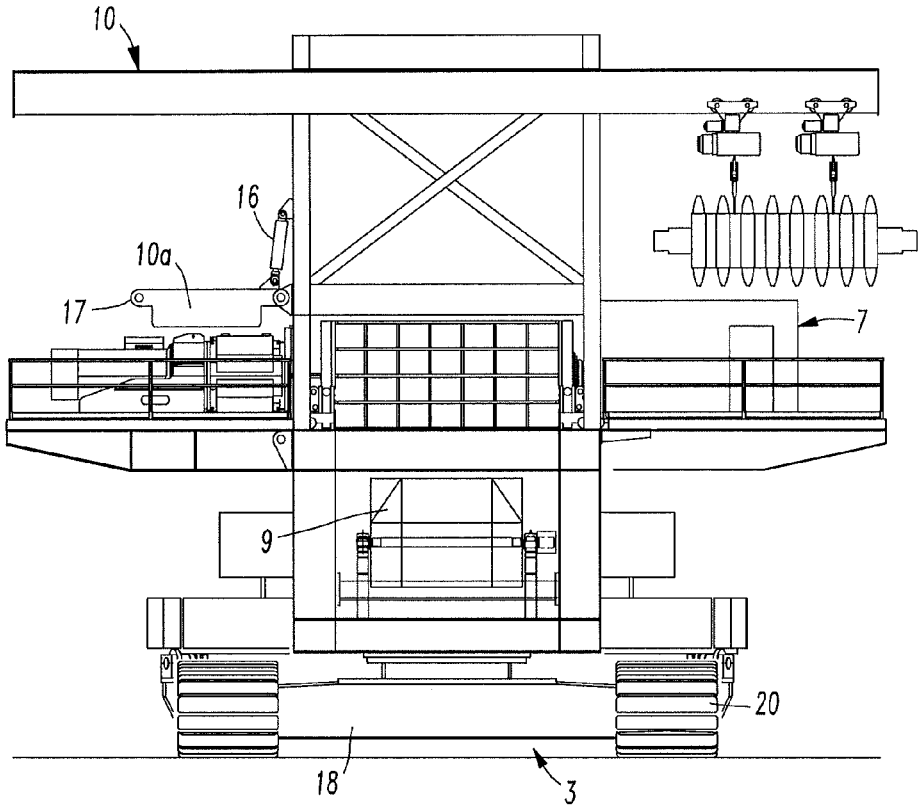
FIG. 4A is an end view similar to FIG. 4 with the moveable frame stanchion in an unlocked position. Also, the tracks 20 of the hopper device 3 are shown in a position that is rotated 90 degrees relative to the tracks 20 shown in FIG. 4.
Figure 5:
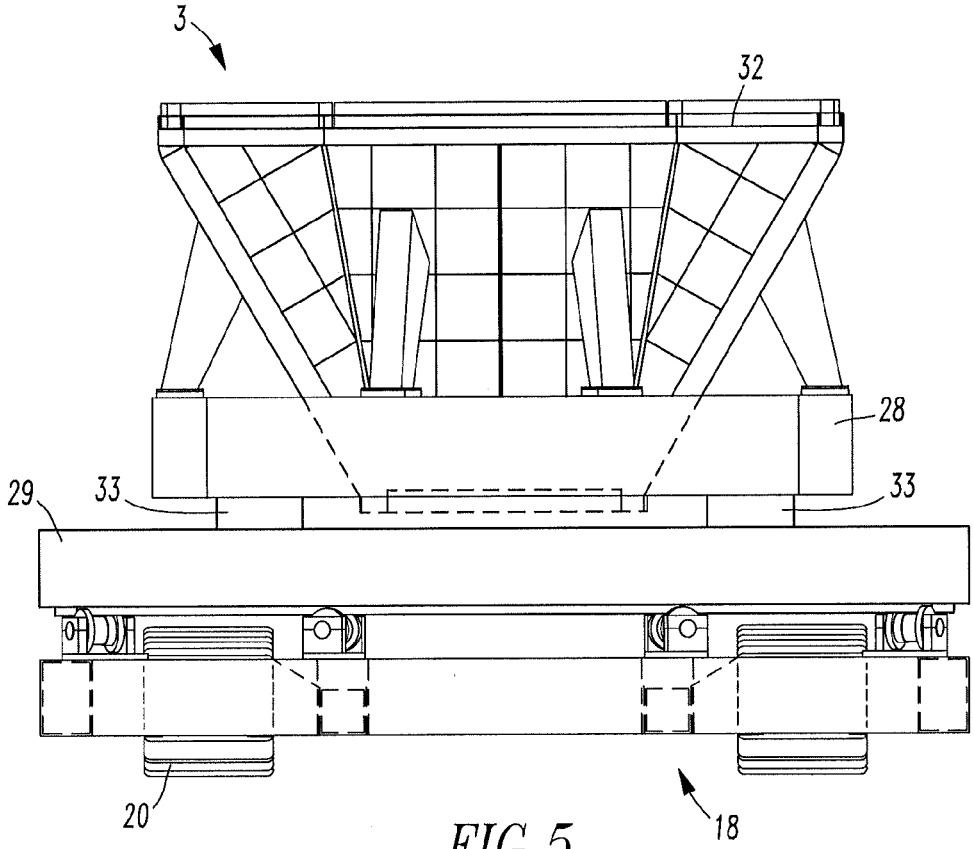
FIG. 5 is an enlarged side view of the hopper device 3 portion of the first present preferred embodiment of the mobile sizing station.
Figure 6:
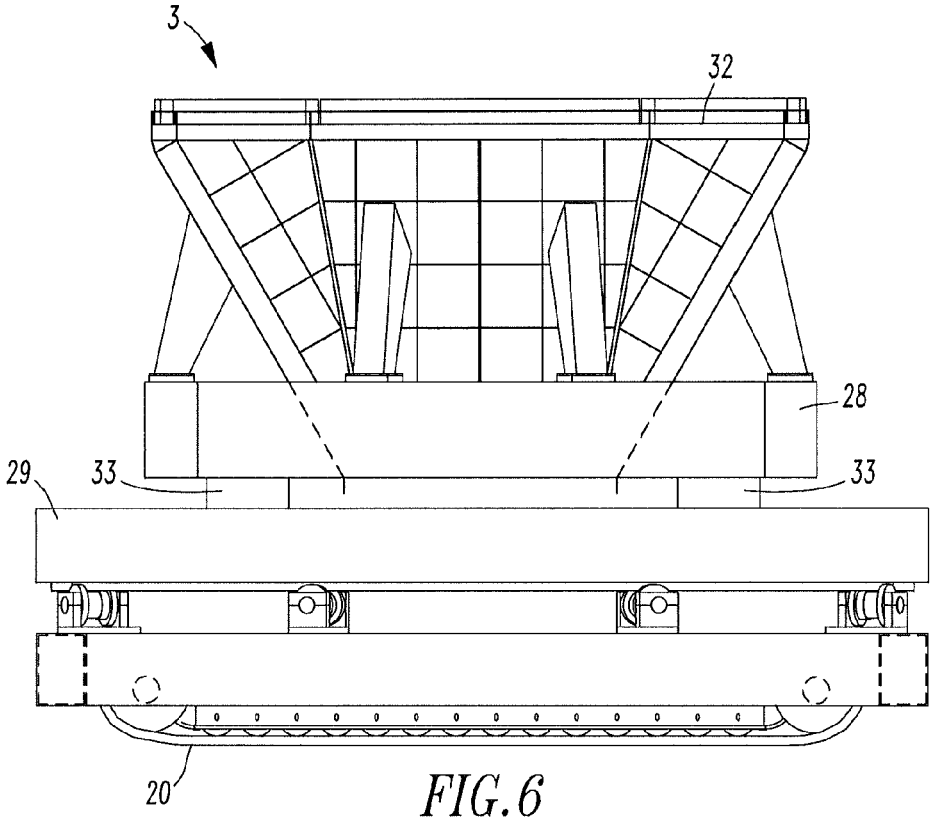
FIG. 6 is an enlarged front view of the hopper device 3 portion of the first present preferred embodiment of the mobile sizing station.
Figure 7:
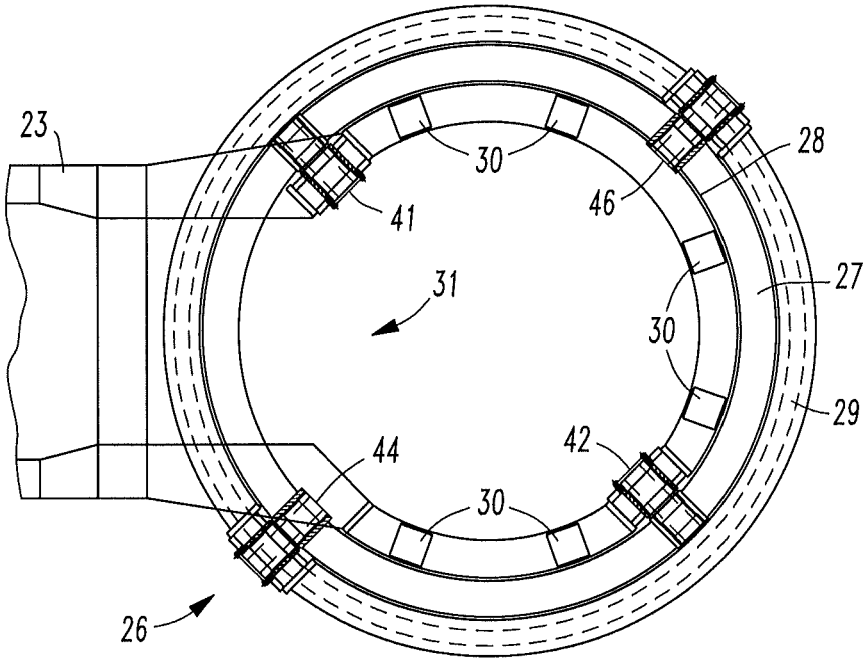
FIG. 7 is a top view of the hopper device with the hopper removed to illustrate frame portions that are supported by the base of the hopper device 3 portion of the first present preferred embodiment of the mobile sizing station. A ring illustrated in broken line illustrates a path of movement of the outer ring 29 frame portion that is defined by bearings 51.
Figure 8:
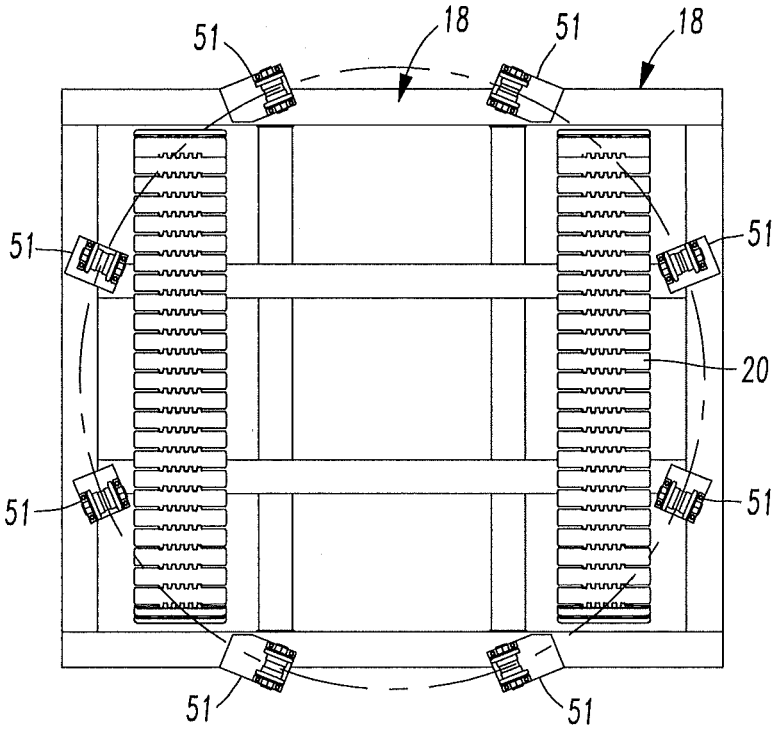
FIG. 8 is a bottom view of the hopper device 3 portion of the first present preferred embodiment of the mobile sizing station with portions of the carbody removed to illustrate bearings 51 that may be positioned or attached to the carbody. A circular path of movement defined by the bearings 51 is shown in chain line.
Figure 9:
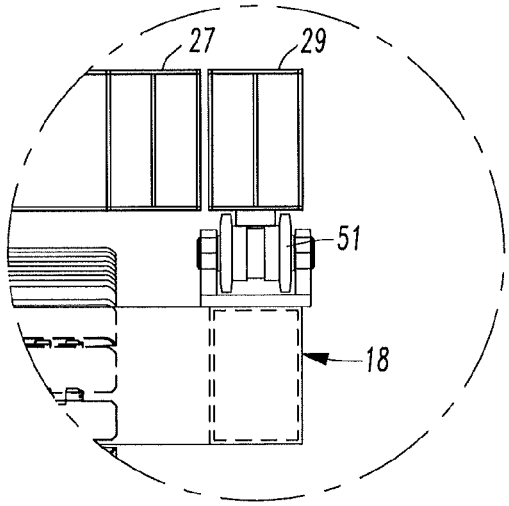
FIG. 9 is an enlarged fragmentary cross sectional view of the hopper device 3 portion of the first present preferred embodiment of the mobile sizing station that illustrates a present preferred bearing supporting a frame portion of the hopper device 3.

A moveable frame stanchion 10*a* may also be attached to the crushing device for permitting workers to maintain the sizer while in operation. The moveable frame stanchion 10*a* may be a moveable support or moveable member that is releasably connected to the frame of the crushing device 4 to support the sizer 7. The moveable frame stanchion 10*a* may be moveable from a locked position, or a raised position, to an unlocked position, or a lowered position, as shown in FIGS. 4 and 4A. When in the locked position, the moveable stanchion 10*a* may support the sizer 7. When in the unlocked position, the moveable stanchion 10*a* may be positioned so that the crushing bodies of the sizer may be replaced or so the sizer may be moved so that maintenance can be performed on the sizer. For example, movement of the moveable stanchion 10*a* to the unlocked position may permit workers to remove a roller of the sizer to replace that roller with a roller that has sharper blades or hammers for crushing material, or with a new rotatable crushing body. For instance, when the moveable stanchion 10*a* is in the raised position, the sizer may be moved along a portion of the frame of the crushing device so that workers may have easier access to the rollers or crushing bodies of the sizer. The sizer may, for example, be rollable on tracks or rails to a position that permits workers easy access to the crushing bodies of the sizer.

The moveable stanchion 10*a* may be connected to the frame of the crushing device via one or more actuators. The one or more actuators may be one or more hydraulic cylinders 16. An extension of the at least one hydraulic cylinder 16 may position the moveable stanchion 10*a* in a locked position. When in the locked position, another cylinder or other mechanism may position a pin within an opening 17 of the moveable stanchion to lock the position of the moveable stanchion into the locked position. When it is desirable to move the moveable stanchion to the unlocked position, the locking pin may be removed via the actuation mechanism and the one or more cylinders 16 may then be retracted to raise the moveable stanchion to the unlocked position. The raising of the moveable stanchion 10*a* may be a pivotal movement about a pivotal connection the moveable stanchion has with the frame of the crushing device 4.

The discharge conveyor device 11 includes a conveyor belt 12 that feeds material from one end adjacent to an output end of the belt feeder 9 to an output end 13. The output end 13 may include a guide to help material be directed into a transport mechanism, such as a conveyor 15, a conveyor device for loading the material onto another mechanism, or a holding mechanism of a large truck. A hopper or other guide may be positioned on a conveyor 15 or other transport mechanism to guide material from the discharge conveyor 12 to the transport mechanism.

Preferably, the discharge conveyor belt 12 is connected to the crusher device 4 such that the discharge conveyor belt is rotatable about the crusher device 4. Such rotational movement may be provided by a slewing cylinder and conveyor yoke connected between the discharge conveyor belt 12 and the frame of the crushing device 4. A central luffing cylinder may be positioned between the crushing device frame and the discharge conveyor belt 12 to permit the inclination of the discharge conveyor belt 12 to also be adjusted.

The crushing device 4 may be configured such that movement of the moveable stanchion may be permitted when the discharge conveyor device 11 is substantially supported on the ground. For instance, embodiments of the mobile sizer station may be sized and configured so that the stress and strain placed on the frame of the crushing device 4 requires movement of the discharge conveyor device 11 so that the discharge conveyor device engages the ground or is otherwise supported on the ground. A distal end of the discharge conveyor belt 12, for example, may be moved to a position so that the distal end of the conveyor belt 12 engages the ground so that the discharge conveyor device is supported at least partially on the ground. Such movement of the discharge conveyor device 11 may permit sufficient stress relief or strain relief to make movement of the moveable stanchion 10*a* possible without putting undue strain and stress on the frame of the crushing device. Once the discharge conveyor device 11 is positioned so that it is at least partially supported on the ground, the moveable stanchion may be unlocked from the frame of the crushing device 4 and moved to the unlocked position, or raised position.

It should be understood that the central luffing cylinder 12*a* may be actuated to move the distal end 12*b* of the discharge conveyor belt 12 so that the distal end 12*b* engages the ground. In some embodiments of the mobile sizing station 1, such movement may be required prior to any actuation of movement for the moveable frame stanchion 10*a*.

The hopper device 3 may include a base that supports the hopper. The base may include a tracked carbody 18 that supports the hopper 32 of the hopper device 3. The carbody 18 may include tracks 20 positioned on opposite sides of the carbody 18. The carbody 18 may support a frame 26 that moveably holds the hopper 32. The frame 26 may include a main frame 28 portion that is connected to a portion of the frame 23 of the crushing device 4 or is a portion of the frame 23 of the crushing device 4. The main frame 28 portion is positioned interior of an inner ring 27 frame portion and an outer ring 29 frame portion and may be positioned over the inner and outer ring frame portions 27 and 29. The main frame portion 28 may at least partially define an opening 31 that is sized and configured to receive an end of the apron feeder so material fed into the hopper 32 may be moved to the sizer 7 of the crushing device 4 via the apron feeder 5.

The main frame 28 portion, inner ring 27 portion and outer ring 29 portions may be separate structures that are interconnected by various fasteners or fastener mechanisms. The main frame 28 portion, inner ring 27 portion and outer ring 29 portion may be nested. Each portion may be positioned slightly above another portion as well. For instance, the outer ring 29 portion may be lower than the inner ring 27 portion. The inner ring 27 portion may be lower than the main frame 28 portion. Of course, the thickness or height of main frame 28, inner ring 27 and outer ring 29 frame portions may have any height or thickness that achieves a particular design objective, such as providing a desired amount of support. Preferably, the height of the base and frame portions permit the hopper 32 to be supported such that the uppermost portion of the hopper 32 is less than or equal to eight meters in height from the ground upon which the hopper device 3 is positioned.

It should be understood that the inner ring 27 portion and outer ring 29 portion may each have a ring-like shape such that the frame portions are generally circular and define an inner central opening. The inner and outer ring portions may also have a generally polygonal shape that defines or at least partially defines an inner opening. For instance, the inner and outer ring portions could be generally hexagonal or octagonal shaped structures and define an inner opening. Thus, the term "ring" as used herein is not merely limited to circular shaped annular structures but also includes polygonal shaped annular structures and elliptical shaped annular structures as well.

The main frame 28 portion may be ring-like in shape as well. Alternatively, the main frame portion may be generally C-like in shape, as may be appreciated from FIG. 7. For embodiments of the main frame 28 portion that are C-like in shape or generally C-like in shape, the main frame portion may be shaped such that an opening is formed between two ends of the main frame portion 28. That opening may be part of the opening 31.

The main frame 28 portion may have mounts 30 for retaining and holding the hopper 32 and may have lugs, shafts 33 or other members that extend downwardly from the main frame portion to a position adjacent to the inner ring 27 frame portion. The inner ring 27 frame portion may define an aperture in which the main frame 28 is positioned. The outer ring 29 frame portion may define an interior aperture that the inner ring 27 and main frame 28 portions are positioned within. The main frame portion 28 may also include a central opening or other aperture that is sized to permit a portion of the apron feeder to reside therein so that material fed into the hopper 32 is moveable to the sizer 7 via the apron feeder 5.

A first inner ring pin 41 and a second inner ring pin 42 are positioned across from each other, or 180 degrees from each other. The first and second inner ring pins 41 and 42 may form a gimble joint. Each of the first and second inner ring pins 41 and 42 may have an end received within an opening formed in the shafts 33 that extend from the main frame 28 to a position adjacent to the inner ring frame 27. The opposite ends of the first and second inner ring pins 41 and 42 may be received within openings in the inner ring frame 27 portion. The first and second inner ring pins 41 and 42 may extend from the shafts 33 to the inner ring frame portion 27 to define an axis of rotation. The first and second inner ring pins 41 and 42 may be considered to be aligned with one another such that the length of the shaft of each pin is in alignment or substantial alignment to define the axis of rotation. The hopper 32 and main frame 28 portion may rotate about the first and second inner ring pins 41 and 42 to rotate vertically about a horizontal axis defined by the first and second inner pins 41 and 42. The hopper 32 and main frame 28 portion may rotate relative to the inner ring frame and outer ring frame portions about the inner ring pins 41 and 42.

A first outer ring pin 44 and a second outer ring pin 46 may be positioned across from one another. The first and second outer ring pins 44 and 46 may form a gimble joint. The first and second outer ring pins 44 and 46 may define an axis that is transverse to the axis defined by the first and second inner ring pins 41 and 42. For example, the axis defined by the first and second outer ring pins 44 and 46 may be perpendicular or substantially perpendicular to the axis defined by the first and second inner ring pins 41 and 42. An example of a substantially perpendicular axis would be an axis that is almost perpendicular to the axis defined by the first and second inner ring pings 41 and 42.

The first and second outer ring pins may extend from the inner ring 27 frame to the outer ring 29 frame and define a horizontal or substantially horizontal axis along which the hopper 32, main frame 28 portion and inner ring frame 27 portion may vertically rotate or tilt. The hopper 32, main frame 28 portion and inner ring frame portion 27 may rotate or tilt about the outer ring pins 44 and 46 relative to the outer ring 29 frame portion.

The outer ring 29 frame portion may be supported on a plurality of bearings 51, such as outboard slew bearing assemblies, slew bearings or other types of bearings. The bearings 51 may be supported on the base of the hopper device 3, such as the carbody 18 or a support connected to the carbody 18. The outer ring frame portion may include a projection 52 that extends into the grooves defined by pulleys or rotating elements of the bearings 51 supported on the carbody 18. The outer ring 29 frame portion may be rotatable along the bearings 51 such that the inner ring 27 frame portion, main frame 28 portion and the hopper 32 of the hopper device are also rotatable in a clockwise direction, counterclockwise direction, or in both clockwise and counterclockwise directions relative to the base of the hopper device 3.

It should be appreciated that the rotational movement of the hopper along with the vertical pivoting movement or tilting movement along two different horizontal axes help facilitate movement of the mobile sizing station 1. For instance, the tiltability of the hopper permits the hopper to be moved up or down while the mobile station 1 is moved along relatively steep ramps, such as ramps that have a ten degree grade, a seven degree grade, or a five degree grade. It is also contemplated that embodiments of the hopper device 3 may be sized and configured to permit the mobile station to move along ramps having a grade that is more than 10 degrees or less than 5 degrees.

Since the tiltability of the hopper is provided for by two different horizontal axes, the hopper may tilt to numerous different positions to improve the stability of the hopper device 3 while the mobile sizing station 1 is moved and the hopper retains material. Further, the rotation of the hopper permits turning movements of the mobile sizing station to occur much more quickly and easily than if the hopper could not rotate relative to the base of the hopper device 3. For example, a turning movement of the mobile sizing station may be made that permits the crushing device to be rotated more quickly than the hopper device 3 because the hopper of the hopper device may rotate to maintain a positioning of an end of the apron feeder 5 with a portion of the hopper 32 even though the hopper device 3 has not rotated or has rotated at a different rate than the crushing device 4.

Due to the rotation and tilting capabilities of the hopper device 3, the mobile sizing station may be moved up an inclined surface while retaining material within the hopper. The movement of the mobile sizing station 1 may also be performed in a much easier, quicker fashion such that repositioning of the mobile sizing station may occur more easily and quickly. Such improvements permit the operational costs associated with the mobile sizing station 1 to be much improved relative to conventional devices. In some contemplated embodiments, material may also be moved from the hopper to the sizer 7 via the apron feeder 5 for crushing material and the material may also be crushed while the mobile sizing station 1 is moved.

Further, because the hopper 32 of the hopper device 3 is moveably supported by the base of the hopper device 3, the repositioning and movement of the mobile sizing station does not require the use of any hydraulic cylinders to lift or lower the hopper 32. Of course, it is contemplated that less preferred embodiments of the mobile sizing station could include a hopper 32 that is vertically moveable via cylinders.

Figure 13:
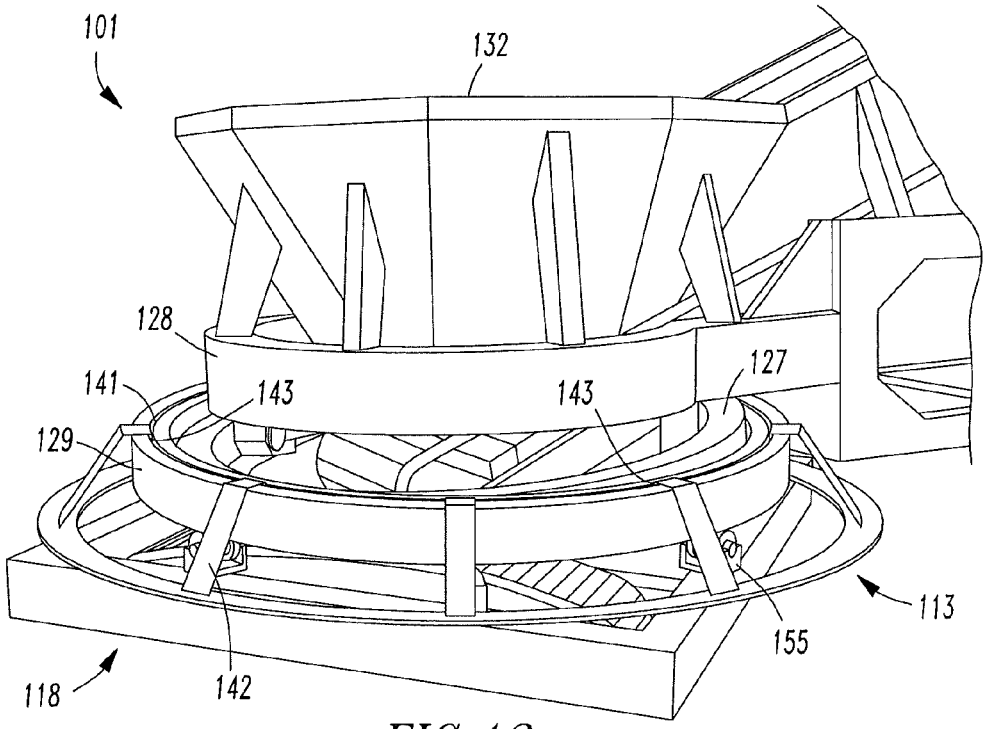
FIG. 13 is a fragmentary perspective view of a present preferred hopper device 3 that may be included in embodiments of the mobile sizing station.

Referring to FIG. 13, some embodiments of the mobile sizing station 101 may include a hopper device 113 that includes a retention mechanism 113. The retention mechanism 113 may be sized and configured to help prevent movement of the hopper 132 from disconnecting the hopper 132 or other portions of the hopper device 113 from being connected to or supported on the tracked carbody 118.

For example, the hopper 132 may be attached to a main frame portion 128 that is connected to an inner ring frame portion 127. The inner ring frame portion may be connected to an outer ring frame portion 129. The connections between the main frame portion, inner ring frame portion and outer ring frame portion may be similar to the connections discussed above with reference to main frame portion 28, inner ring frame portion 27 and outer ring frame portion 29.

The outer ring frame portion 129 may also include a groove or channel 141 formed therein. The retention mechanism 113 may include plates 142 that extend from the carbody 118 or a support connected to the carbody 118. The plates 142 may include a projecting end portion 143 that is sized to be received within the groove or channel 141 such that the outer ring 129 may still be rotatable abut rotatable supports 155 supported by the carbody 118. However, if the outer ring 129 or hopper 132 tilts to a predetermined degree, the engaging portions 143 of the plates may engage the outer ring frame portion 129 via the groove to prevent the hopper 132 from being over tilted to an unstable position that may cause the hopper 132 to fall off the carbody 118 or become disconnected to or unsupported by the carbody 118.

In alternative embodiments, the retention mechanism 113 may include plates or other members, such as generally J shaped members may extend from the carbody 118 or a support attached to the carbody 118 to the inner ring 127 frame portion such that a projecting portion of the members are received within a groove formed in the inner ring frame 127 portion.

As yet another alternative embodiment of the retention mechanism 113, members may extend from the carbody 118 or extend from a position adjacent to the carbody 118. A distal end of each member may have a mouth or opening that is shaped to receive a bead that extends continuously around the periphery of the inner ring frame portion or outer ring frame portion. The bead may be a weldment or may be an integral portion of the inner ring frame portion. That mouth may be shaped to permit a desired degree of tilting of the inner ring 127 frame portion, but engage or securely engage the bead if the inner ring frame portion tilts to a predetermined degree or position. Of course, in yet other alternative embodiments of the retention mechanism, the plates may extend from adjacent to the carbody 118 to a position adjacent to the outer ring 129 frame portion to receive a bead formed on the outer ring frame portion.

Figure 10:
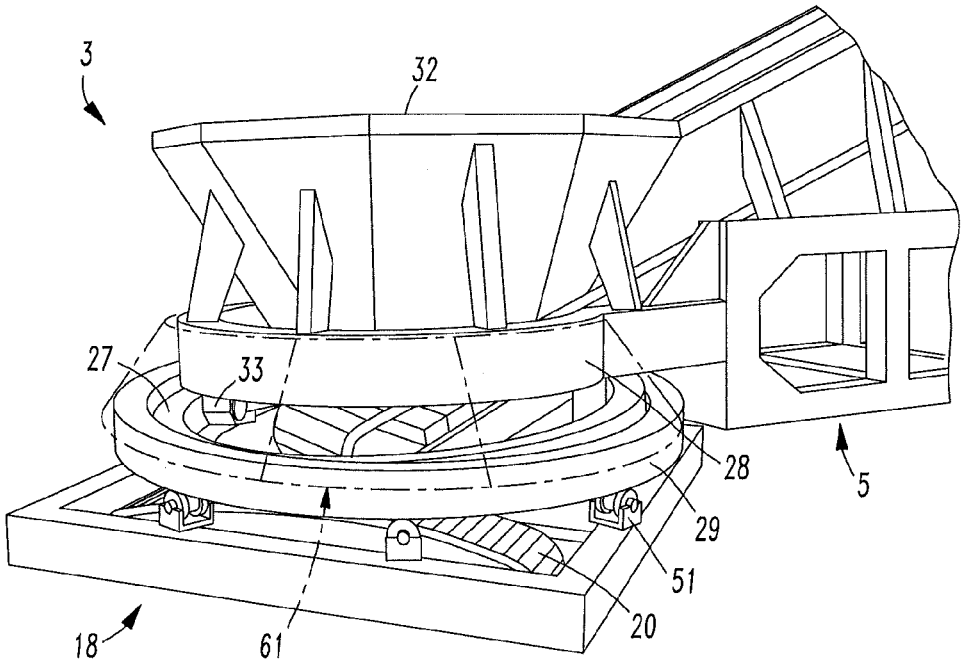
FIG. 10 is a fragmentary perspective view of the first present preferred embodiment of the mobile sizing station that illustrates the hopper device 3 and apron feeder 5. A present preferred embodiment of a skirt 61 that may be utilized with the hopper device in embodiments of the mobile sizing station is shown in dotted line in FIG. 10.
Figure 11:
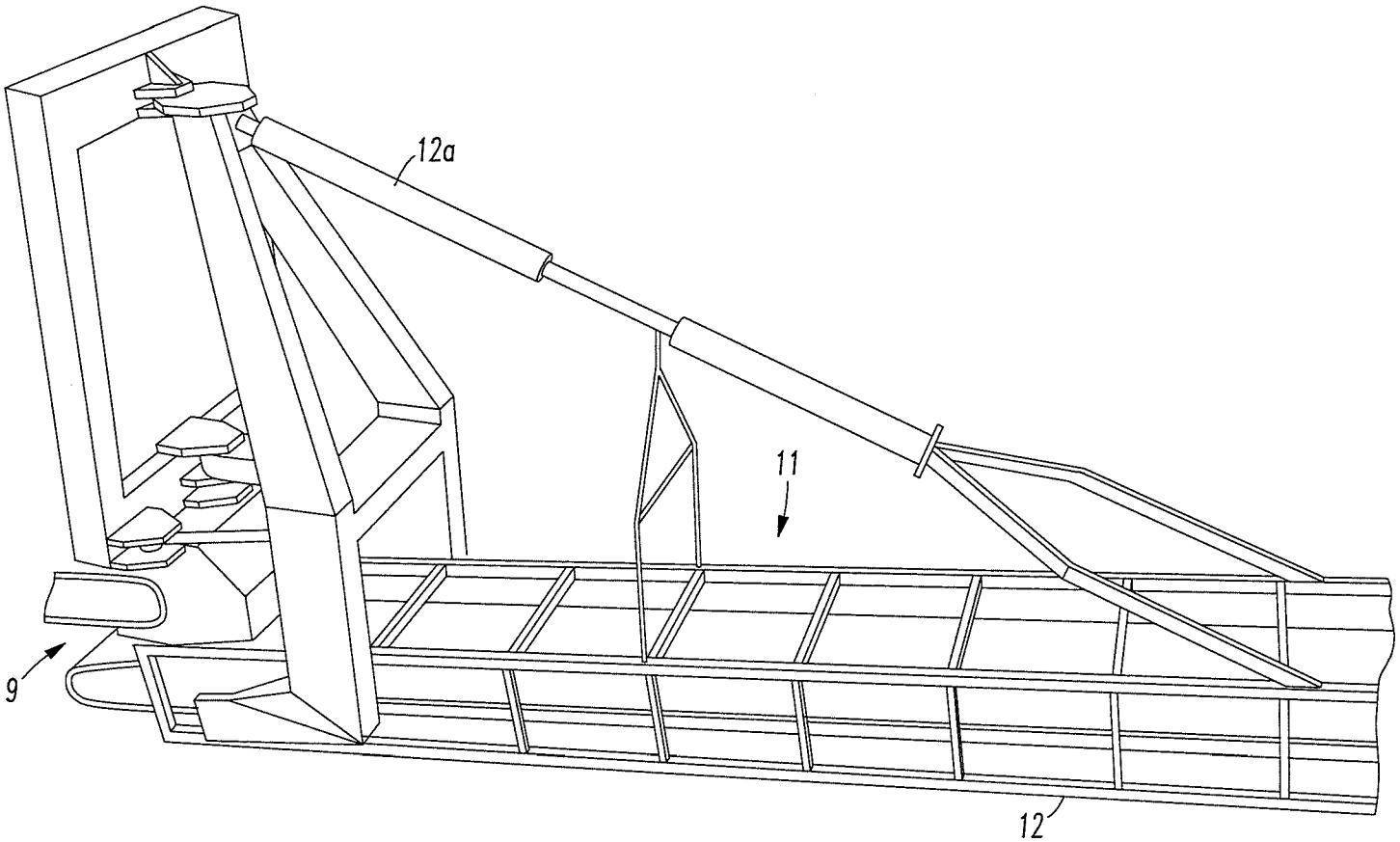
FIG. 11 is a fragmentary perspective view of the first present preferred embodiment of the mobile sizing station.
Figure 12:
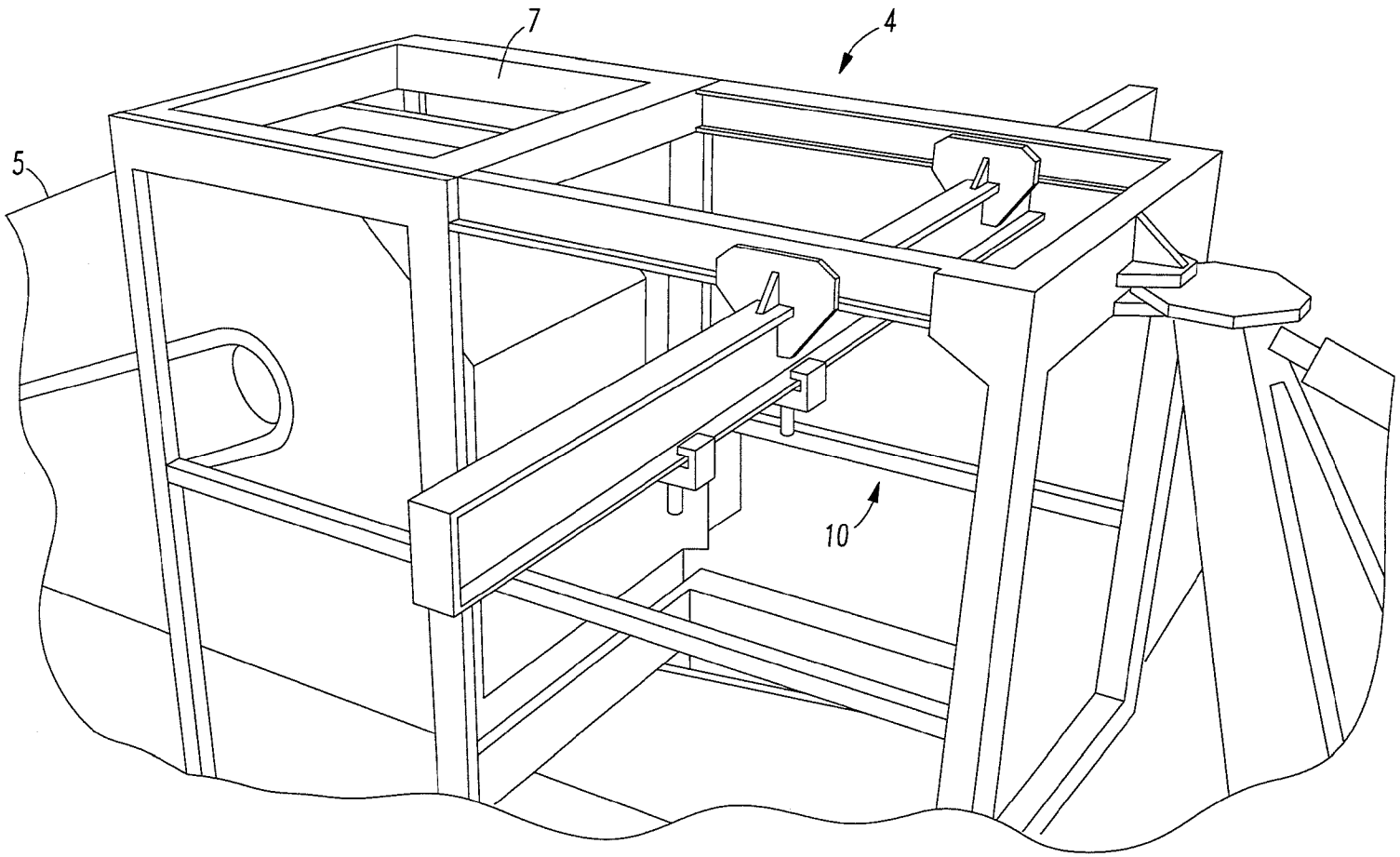
FIG. 12 is a fragmentary perspective view of the fragmentary perspective view of the first present preferred embodiment of the mobile sizing station that illustrates the sizer 7 and apron feeder 5.

Referring to FIG. 10, it is also contemplated that a skirt 61 may be connected to the hopper 32 or the main frame 28 portion to cover the inner ring frame portion and outer ring frame portion 27 and 29. For instance, a skirt may be composed of rubber and have a top portion connected to the hopper 32, the main frame portion 28 or both the hopper 32 and main frame portion 28. The skirt may extend down to a position adjacent to the outer ring frame portion 29 or below the outer ring frame portion 29. The bottom of the skirt may be configured to hang or may be supported or attached to a portion of the carbody or the outer ring frame portion 29. The skirt is preferably sized and configured to block debris from falling onto the outer ring frame portion 29 or inner ring frame portion 27. It should be understood that embodiments of the skirt may be sized and configured to also cover any retention mechanism that may be included in the hopper device 3 as well.

In alternative embodiments, it is contemplated that the skirt 61 may be composed of metal such as steel and may be attached to the main frame portion 28 at one side and to the outer ring frame portion 29 at an opposite side. In yet other alternative embodiments, the skirt may be attached to the hopper 32 at a top side and be attached to the outer ring frame portion 29 or the carbody 8 at its bottom side.

It should be appreciated that movement of embodiments of the mobile sizing station 1 also may not require the unloading of the hopper or evacuation of material in the sizer or hopper. Such an improvement may permit the operational costs associated with embodiments of the mobile sizing station to be much improved relative to conventional devices that require such evacuation of material to permit movement of a sizing station.

The mobile sizing station may also include a controller to control movement of the mobile sizing station 1, the crushing device 4, the discharge conveyor 11, the apron feeder 5, the sizer 7, and the hopper device 3. Alternatively, each mechanism may have its own respective controller connected thereto. A computer device or one or more steering actuators such as levers or other steering mechanisms may be provided for permitting manual control of a particular mechanism or the mobile sizing station 1.

A controller that includes one or more processing units such as microcontrollers connected to one or more memory units, such as non-transitory memory units, may be connected to the mobile sizing station 1. The controller may be a portion of a computer device. For instance the controller may be a computer, a workstation, or may be one or more programmable logic controllers (PLCs) connected to the mobile sizing station. A plurality of input devices such as keyboards, keypads or a mouse and one or more display devices such as a monitor or LCD screen may be connected to the controller to provide input and receive output from the controller. A memory unit of the controller may contain one or more software applications that are run via a processing element to control movements of different mechanisms of the device. Alternatively, different mechanisms may be manually controlled via mechanical or electro-mechanical actuation mechanisms.

Sensors may be connected to the mobile sizing station and to the controller so that measurements or other situations may be detected by the controller. For instance, the sensors may include one or more GPS sensors to determine or monitor the location and movement of the mobile sizing station 1. Sensors may also be connected to the apron feeder and discharge conveyor to monitor or measure conveyor belt movement speeds and sensors may also be connected to the sizer 7 to monitor or measure operational conditions of the sizer 7.

It should be appreciated that the controller may be directly connected to the different mechanisms or sensors via wires or may be wirelessly connected to some or all of the mechanisms and sensors. The controller may also be remotely positioned and able to connect to the different sensors and mechanisms for monitoring, controlling or actuating certain operations of the mobile sizing station. Such a connection may be a network connection, intranetwork connection, or internetwork connection.

It should be understood that various modifications may be made to the embodiments of the mobile sizing station 1 discussed above. For instance, the frame of the crushing device 4 may be shaped or structured in any of a number of shapes to achieve a desired design objective. As another example, the type or capacity for the sizer 7 or other crushing mechanism may be any of a number of different commercially available options. As yet another example, the type of discharge conveyor 11 or apron feeder 5 that may be used could be any of a number of different options in size and capacity to meet a desired design objective. As yet an additional example, the types of tracks used in embodiments of the mobile sizing station 1 may be any of a number of different types that may meet a particular design objective.

While certain present preferred methods of the mobile sizing station have been shown and described above, it is to be distinctly understood that the invention is not limited thereto but may be otherwise variously embodied and practiced within the scope of the following claims.

What is claimed is:

1. A mobile sizing station comprising:

a crushing device having a crushing mechanism;

a hopper device, the hopper device having a hopper; and a conveyor device positioned between the crushing device and the hopper of the hopper device, the conveyor device configured to move material from the hopper of the hopper device to the crushing mechanism of the crushing device; and the hopper device also comprised of a base that moveably supports the hopper, the base comprising a movable support, a first frame portion, a second frame portion and a third frame portion, the first frame portion supported by the movable support, the second frame portion being pivotally connected to the first frame portion, the third frame portion being pivotally connected to the second frame portion, the second frame portion being positioned between the first and third frame portions.

2. The mobile sizing station of claim 1 wherein the first frame portion is rotatably supported by the movable support.

3. The mobile sizing station of claim 2 wherein the base of the hopper device is further comprised of a plurality of bearings connected to the movable support, the bearings supporting the first frame portion such that the first frame portion is rotatable along a path defined by the bearings.

4. The mobile sizing station of claim 1 wherein the pivotal connection of the second frame portion to the third frame portion is comprised of a plurality of first pins that define a first tilt axis for the hopper of the hopper device.

5. The mobile sizing station of claim 4 wherein the pivotal connection of the first frame portion to the second frame portion is comprised of a plurality of second pins that define a second tilt axis for the hopper of the hopper device.

6. The mobile sizing station of claim 5 wherein the first tilt axis is transverse or perpendicular to the second tilt axis.

7. The mobile sizing station of claim 5 wherein the plurality of first pins are inner ring pins and the first frame portion is an outer ring frame portion and wherein the plurality of second pins are outer ring pins and the second frame portion is an inner ring frame portion.

8. The mobile sizing station of claim 7 wherein the third frame portion is sized and configured to directly connect to the hopper via at least one hopper mount.

9. The mobile sizing station of claim 1 wherein the crushing mechanism is comprised of at least one sizer and wherein the hopper device is also comprised of a skirt connected to at least one of the hopper and the third frame portion of the hopper device, the skirt extending to a position adjacent to the first frame portion of the hopper device to block debris from falling onto at least one of a portion of the first frame portion and a portion of the second frame portion.

10. The mobile sizing station of claim 1 wherein the first, second and third frame portions are nested and wherein the third frame portion is positioned higher than the first frame portion and is pivotally connected to the second frame portion via a plurality of members that extend downwardly from the third frame portion to a position adjacent to the second frame portion, each of the members receiving a respective pin extending from the second frame portion to form the pivotal connection between the second frame portion and the third frame portion.

11. The mobile sizing station of claim 1 wherein the hopper device is also comprised of a retention mechanism extending from adjacent to the base of the hopper device to a position adjacent to the first frame portion of the hopper device or to a position adjacent to the second frame portion of the hopper device.

12. A mobile crushing station comprising:

a crushing device having a crushing mechanism connected to a frame of the crushing device, the frame of the crushing device connected to a base of the crushing device, the base of the crushing device having a plurality of tracks;

a hopper device, the hopper device having a hopper; and a conveyor device positioned between the crushing device and the hopper of the hopper device, the conveyor device configured to move material from the hopper of the hopper device to the crushing mechanism of the crushing device such that material fed to the hopper is moveable to the crushing mechanism, the conveyor device connected to the crushing device such that the conveyor device moves to a new position when the crushing device moves to a new position via movement of the tracks of the crushing device, and the hopper device also comprised of a base that moveably supports the hopper, the base of the hopper device being below the hopper, the base of the hopper device comprising a moveable support, a first frame portion, a second frame portion and a third frame portion, the first frame portion rotatably supported by the moveable support, the second frame portion being pivotally connected to the first frame portion, the third frame portion being pivotally connected to the second frame portion, the second frame portion being positioned between the first and third frame portions.

13. The mobile crushing station of claim 12 wherein the pivotal connection of the second frame portion to the third frame portion is comprised of a first pin and a second pin, each of the first pin and second pin having a first end and a second end opposite the first end, the first end of the first pin connected to the third frame portion and the second end of the first pin connected to the second frame portion, the first end of the second pin connected to the third frame portion and the second end of the second pin connected to the second frame portion.

14. The mobile crushing station of claim 13 wherein the pivotal connection of the second frame portion to the first frame portion is comprised of a third pin and a fourth pin, each of the third pin and the fourth pin having a first end and a second end opposite the first end, the first end of the third pin connected to the second frame portion and the second end of the third pin connected to the first frame portion, the first end of the fourth pin connected to the second frame portion and the second end of the fourth pin connected to the first frame portion.

15. The mobile crushing station of claim 14 wherein the first pin and second pin are positioned in alignment to define a first tilt axis and the third and fourth pins are positioned in alignment to define a second tilt axis that is transverse or perpendicular to the first tilt axis.

16. The mobile crushing station of claim 14 wherein the first frame portion is a ring shaped frame structure and the second frame portion is a ring shaped frame structure and wherein the third frame portion is a generally C-shaped portion of the frame of the crushing device or is a generally C-shaped structure connected to the frame of the crushing device.

17. A mobile sizing station comprising:

a crushing device having a crushing mechanism, a frame connected to the crushing mechanism, and a base connected to the frame, the base of the crushing device having tracks;

a hopper device, the hopper device having a hopper; and a conveyor device connected between the crushing device and the hopper of the hopper device, the conveyor device configured to move material from the hopper of the hopper device to the crushing mechanism of the crushing device; and the hopper device also comprised of a base that moveably supports the hopper, the base of the hopper device comprising at least one track connected to a carbody, the carbody supporting a first frame portion, a second frame portion and a third frame portion, the first frame portion rotatably supported by the carbody, the second frame portion being pivotally connected to the first frame portion, the third frame portion being pivotally connected to the second frame portion.

18. The mobile sizing station of claim 17 wherein the first frame portion is rotatably supported by the carbody via a plurality of bearings or a plurality of slew bearings connected to the carbody.

19. The mobile sizing station of claim 18 wherein the base of the hopper device is below the hopper and the pivotal connection of the second frame portion to the third frame portion is comprised of a plurality of first pins that define a first tilt axis for the hopper of the hopper device and the pivotal connection of the third frame portion to the second frame portion is comprised of a plurality of second pins that define a second tilt axis for the hopper of the hopper device, the second tilt axis being transverse or perpendicular to the first tilt axis.

20. The mobile sizing station of claim 17 wherein the hopper device does not use hydraulic cylinders to lift and lower the hopper and material is retainable in the hopper during movement of the mobile sizing station to move the mobile sizing station along ground to a new location.

* * * * *